US010751634B2

(12) United States Patent
Wood

(10) Patent No.: US 10,751,634 B2
(45) Date of Patent: Aug. 25, 2020

(54) WHEEL WELL SYSTEM AND METHOD FOR MODEL VEHICLES

(71) Applicant: Traxxas LP, McKinney, TX (US)

(72) Inventor: Jonathan Scott Wood, Frisco, TX (US)

(73) Assignee: TRAXXAS LP, McKinney, TX (US)

( * ) Notice: Subject to any disclaimer, the term of this patent is extended or adjusted under 35 U.S.C. 154(b) by 0 days.

(21) Appl. No.: 16/481,376

(22) PCT Filed: Jan. 29, 2018

(86) PCT No.: PCT/US2018/015663
§ 371 (c)(1),
(2) Date: Jul. 26, 2019

(87) PCT Pub. No.: WO2018/140848
PCT Pub. Date: Aug. 2, 2018

(65) Prior Publication Data

US 2020/0001194 A1 Jan. 2, 2020

Related U.S. Application Data

(60) Provisional application No. 62/451,642, filed on Jan. 27, 2017.

(51) Int. Cl.
*A63H 17/26* (2006.01)
*A63H 17/00* (2006.01)
*B62D 31/00* (2006.01)

(52) U.S. Cl.
CPC ..... *A63H 17/262* (2013.01); *A63H 17/002* (2013.01)

(58) Field of Classification Search
CPC .... A63H 33/00; A63H 33/003; A63H 17/002; A63H 17/26; A63H 17/262; A63H 17/28;
(Continued)

(56) References Cited

U.S. PATENT DOCUMENTS 1,877,661 A * 9/1932 Heisler ..... A63H 33/003 446/95
2,791,867 A * 5/1957 Dasher ..... A63H 33/003 446/95

(Continued)

FOREIGN PATENT DOCUMENTS

WO 2018140848 A1 8/2018

OTHER PUBLICATIONS

International Search Report, dated Jun. 27, 2018, by the ISA/KR, re PCT International App No. PCT/US2018/015663.

(Continued)

*Primary Examiner* — Kien T Nguyen
(74) *Attorney, Agent, or Firm* — Daryl R. Wright; Greg Carr

(57) ABSTRACT

A wheel well system and method for a model vehicle are provided. The wheel well system may include a wheel well apparatus having a wheel well configured to fit within a wheel well recess of a model vehicle body. The wheel well comprising body attachment bores, support member bores. The wheel well apparatus may include a support member configured to couple to the wheel well. The wheel well system may also have two wheel wells configured to fit within wheel well recesses and a support member attached to the two wheel wells. The two wheel wells are configured to fixedly couple to the model vehicle body via the body attachment bores. The method may include providing a wheel well fixedly coupled to a support member and fixedly coupling the wheel well to a model vehicle body.

20 Claims, 10 Drawing Sheets

(58) Field of Classification Search
CPC ..... B62D 31/00; B62D 53/00; B62D 53/06; B62B 9/00; B62B 9/14
USPC ..... 446/93, 95, 465, 470; 180/89.1, 21; 280/848, 849
See application file for complete search history.

(56) References Cited

U.S. PATENT DOCUMENTS

| | | | | |
|---|---|---|---|---|
| 4,088,339 | A | 5/1978 | Sagebiel | |
| 5,829,786 | A | 11/1998 | Dahl | |
| 7,214,119 | B2 * | 5/2007 | Lucas | A63H 3/06 446/220 |
| 2004/0264207 | A1 | 12/2004 | Jones | |
| 2007/0267237 | A1 | 11/2007 | Hanson et al. | |
| 2015/0093963 | A1 * | 4/2015 | Silverglate | A63H 17/38 446/470 |
| 2016/0144902 | A1 | 5/2016 | Sartorio et al. | |

OTHER PUBLICATIONS

Written Opinion, dated Jun. 27, 2018, by the ISA/KR, re PCT International App No. PCT/US2018/015663.

* cited by examiner

WHEEL WELL SYSTEM AND METHOD FOR MODEL VEHICLES

RELATED APPLICATIONS

This application claims the benefit of a related U.S. Provisional Application Ser. No. 62/451,642 filed Jan. 27, 2017, entitled "WHEEL WELLS FOR MODEL VEHICLES," to Jonathan Scott WOOD, et. al., the disclosure of which is incorporated by reference herein in its entirety for all intents and purposes.

BACKGROUND

The following descriptions and examples are not admitted to be prior art by virtue of their inclusion in this section.

In model vehicles, wheels rotate within open recesses of a vehicle body leaving the inner surface of the mounted body and various internal parts exposed. The exposed inner surface of the body may be unsightly to users and may put internal components and electronics of the model vehicle at risk of being damaged or dirtied by rocks, dirt, mud, dust and various other form of debris kicked up by the wheels. Accordingly, there is a need for inner wheel wells to visually block the inner surfaces of the body as well as protect the interior components of the model vehicle.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments of the current disclosure may include a wheel well apparatus for a model vehicle. The wheel well apparatus may further include a wheel well configured to fit within a wheel well recess of a model vehicle body. The wheel well comprising body attachment bores, support member bores. In addition, the wheel well apparatus may include a support member configured to couple to the wheel well.

An additional embodiment of the current disclosure may include a wheel well system for a model vehicle. The wheel well system may include two wheel wells configured to fit within corresponding wheel well recesses of a model vehicle body and a support member fixedly coupled to the two wheel wells. The wheel well system may further include body attachment bores. Wherein the two wheel wells are configured to fixedly couple to the model vehicle body via the body attachment bores.

Another embodiment of a wheel well system of the current disclosure includes a method for protecting a model vehicle including providing a wheel well fixedly coupled to a support member. The method further includes fixedly coupling the wheel well to a model vehicle body via body attachment bores of the wheel well. Wherein the wheel well is configured to fit within a wheel well recess of the model vehicle body and the wheel well is configured to inhibit debris from entering an interior of the model vehicle.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following discussion, numerous specific details are set forth to provide a thorough understanding of the embodiments of the present disclosure. However, those skilled in the art will appreciate that the embodiments may be practiced without such specific details. Additionally, for the most part, specific details, and the like have been omitted inasmuch as such details are not considered necessary to obtain a complete understanding of the embodiments of the present disclosure.

Figure 1A:
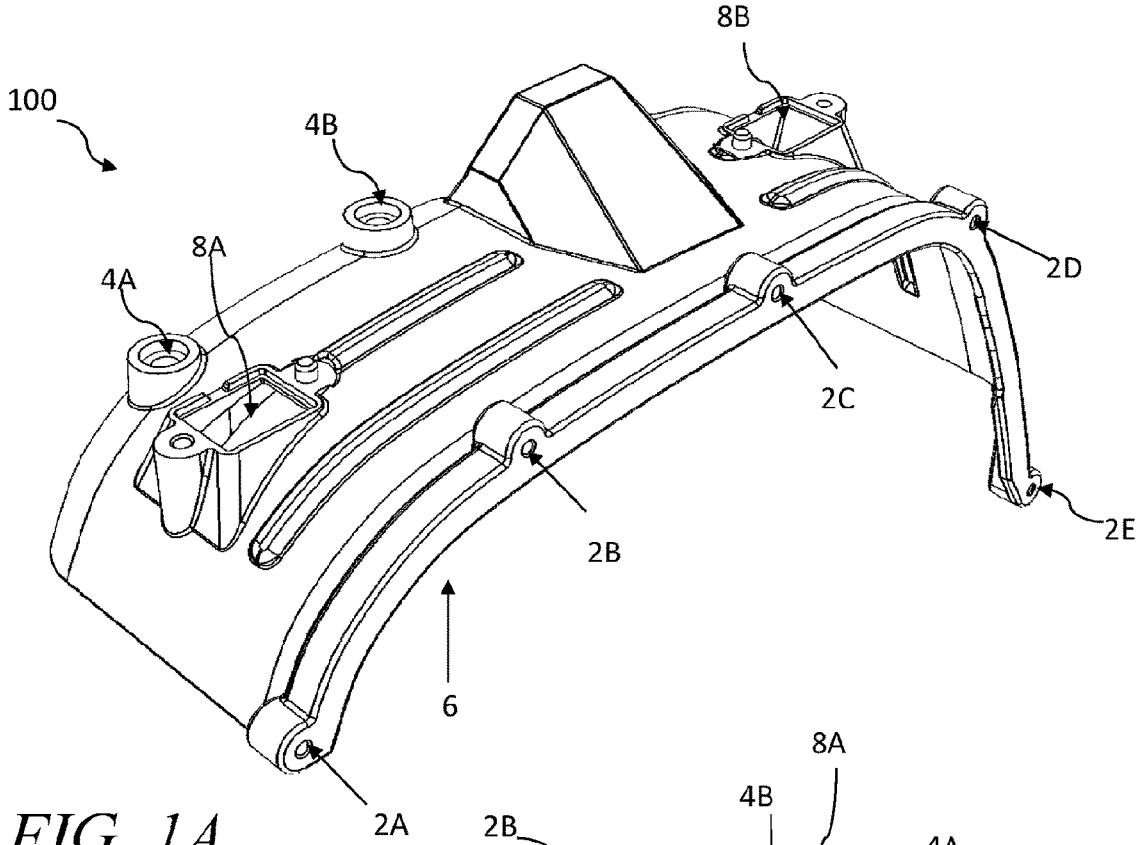
FIGS. 1A and 1B illustrate perspective views of a wheel well for a model vehicle.
Figure 1B:
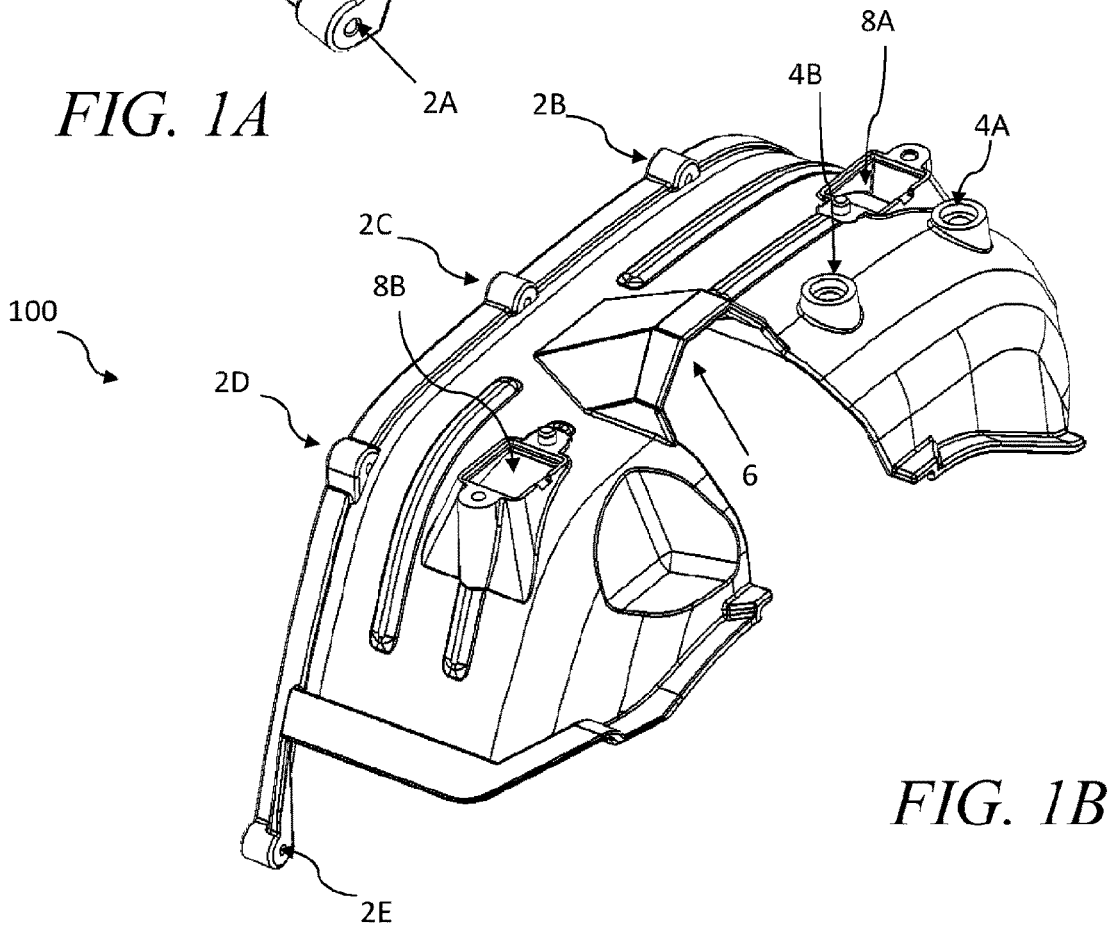
Figure 2:
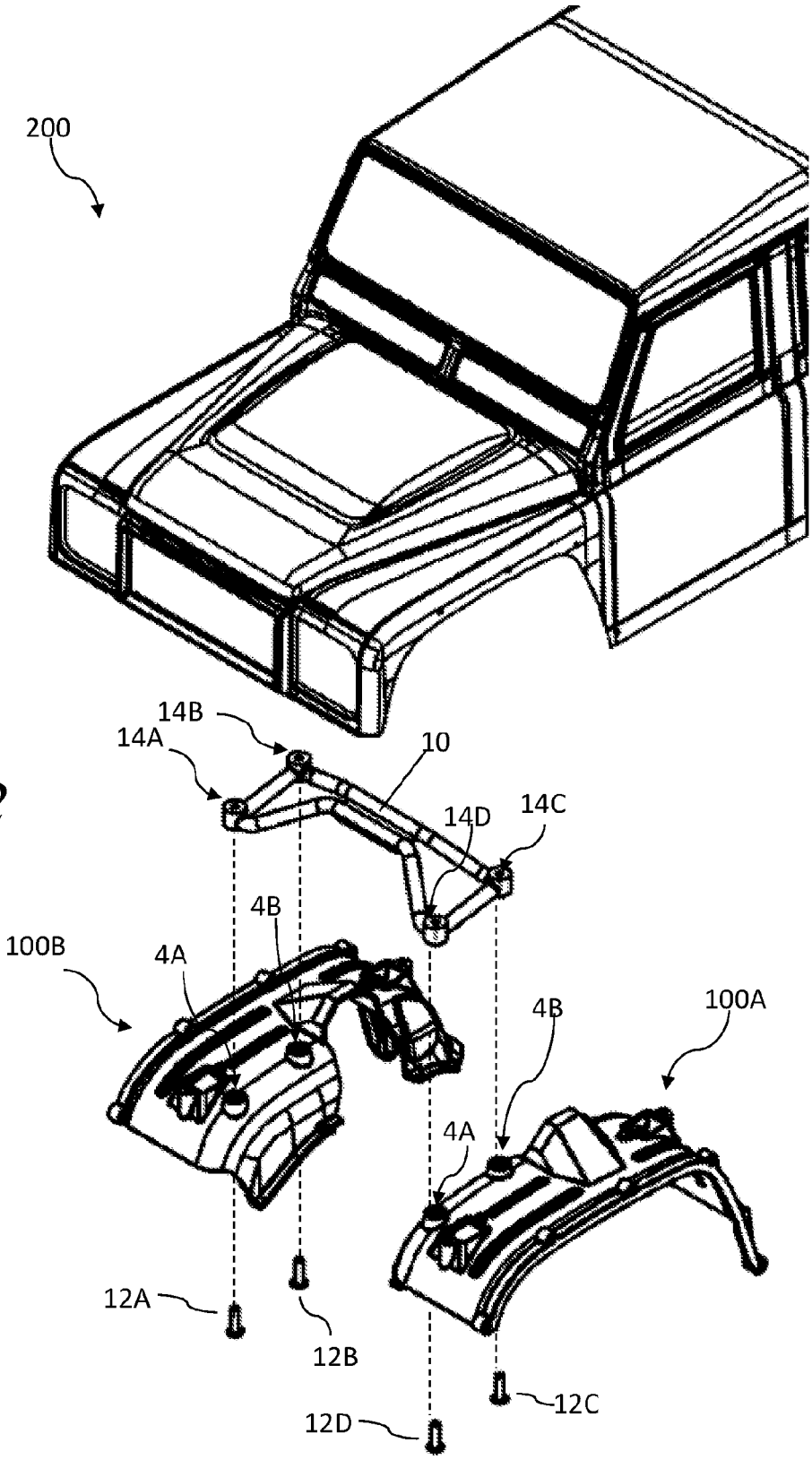
FIG. 2 illustrates a left and a right wheel well positioned for assembly to a front portion of a model vehicle body.

Turning to FIGS. 1 and 2, the reference numeral 100 generally indicates an embodiment of a wheel well 100 use with a vehicle body 200 of a model vehicle. In the illustrative embodiment shown, the wheel well 100 comprises a number of body attachment bores 2A-2E (e.g. five in this example), a number of support member bores 4A and 4B (e.g. two in this example), and an interior surface 6. The number of body attachment bores and support member bores may be varied depending upon the size of the wheel well 100 and the vehicle body 200 the wheel well 100 is intended to be used with.

The wheel wells 100 may be secured either directly to a chassis (not shown) of the model vehicle or to the vehicle body 200, however, in both cases the wheel well 100 is position between an interior surface of the vehicle body 200 and a wheel (not shown) of the model vehicle. The choice of mounting locations may be due in part, but not limited to, the scale of the vehicle, ease of access to the chassis, and amount of suspension travel. In the exemplary embodiment shown, the wheel well 100 is attached to the vehicle body 200 to allow the wheel wells to be easily removed when the vehicle body 200 is removed.

The wheel wells 100 may be unique to the front and rear portions of the model vehicle and may be mirrored right to left across the width of the model vehicle. The embodiment of the wheel well 100 shown in FIGS. 1A and 1B may be secured to a front portion of the vehicle body 200 on the left side of the vehicle.

FIG. 2 shows an embodiment of the wheel wells 100A and 100B configured for attachment to the front portion of the model vehicle body 200. As shown, wheel well 100A may be secured to the left side of the vehicle body 200, and wheel well 100B may be secured to the right side of the vehicle body 200. The use of the terms left and right is taken from a perspective of a driver sitting inside of the model vehicle, as in a full sized vehicle. In this embodiment, wheel well 100A and wheel well 100B may be configured as mirrored images of one another.

As further shown in FIG. 2, wheel wells 100A and 100B may be secured together to one another via a front support member 10, prior to being attached to the front portion of the vehicle body 200. Wheel wells 100A and 100B may be removably secured to the front support member 10 by using mechanical fasteners 12A-12D, through support member bores 4A-4D, and then further into support attachment bores 14A-14D in front support member 10. Of course front support member 10 may be formed integrally with wheel wells 100A and 100B or attached using permanent or removable fasteners.

Figure 4:
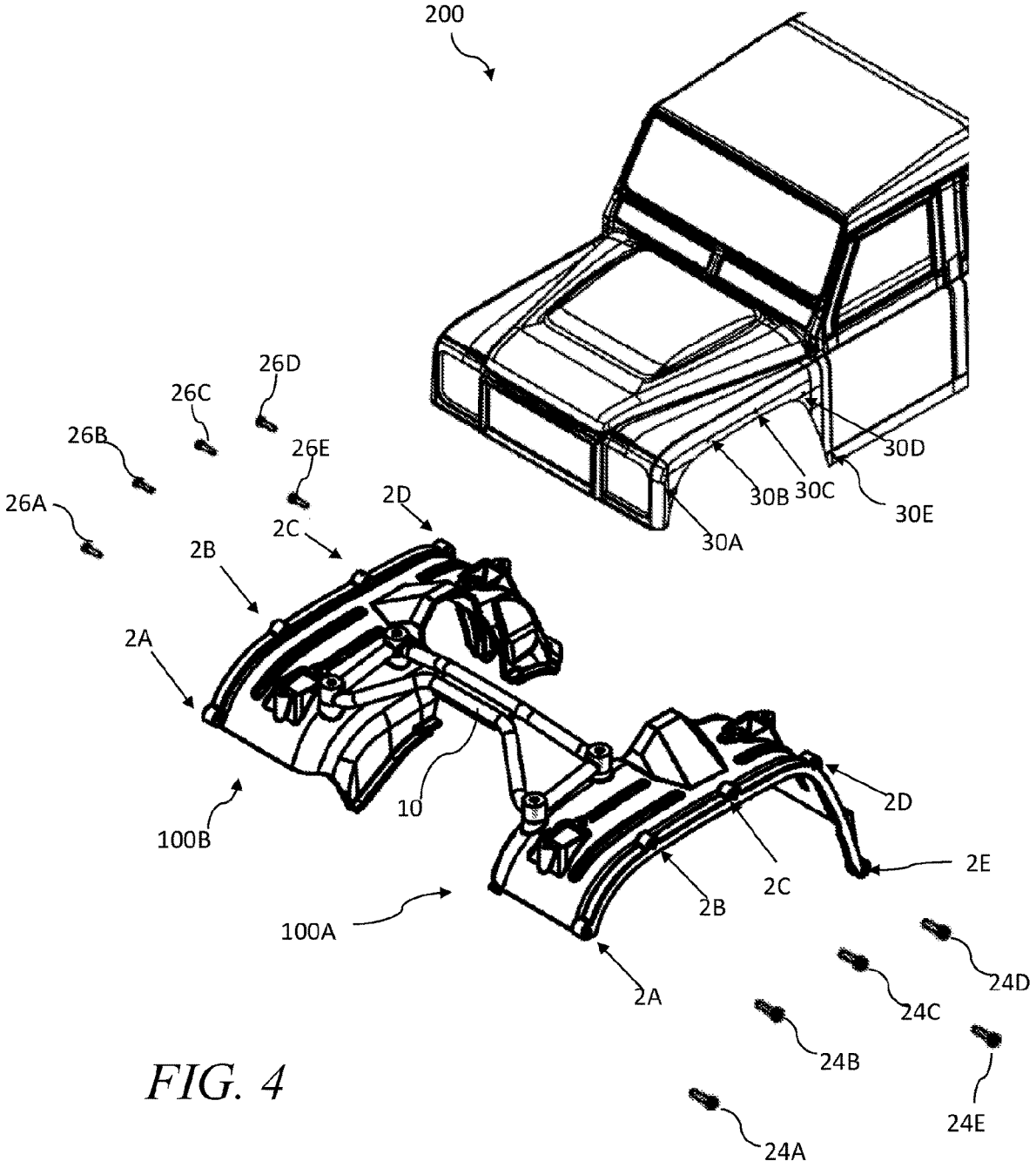
FIG. 4 illustrates the left and right front wheel wells assembled with a front supporting member.

Connecting the left and right wheel wells 100A, 100B creates a rigid structure as shown in FIG. 4 that may provide the front portion of the vehicle body 200 with additional support when the wheel wells 100A, 100B are attached to the vehicle body 200. The fasteners used for connecting wheel wells 100A and 100B may include but is not limited to screws, nails, bolts, pins, clips, lugs and the like. Of course, as stated earlier, the support structure 10 may be formed as a single component with the wheel wells 100A, 100B, or snapped in place, held with adhesive, or any other form of fastening known or developed.

In an alternative embodiment of the wheel wells 100, the left and right wheel wells 100 may be directly secured to each without the need for an additional support member.

Figure 3:
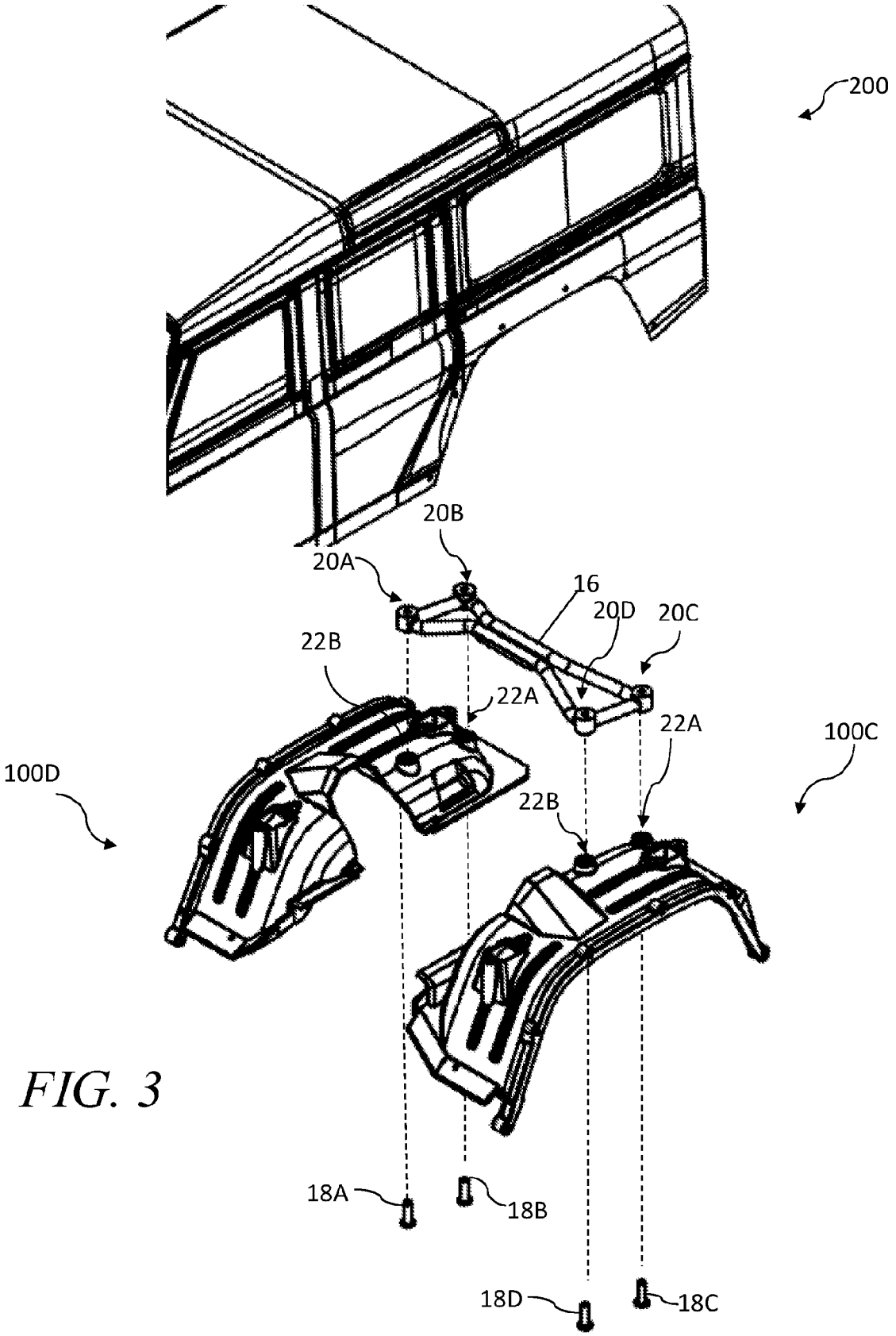
FIG. 3 illustrates a left and a right wheel well positioned for assembly to a rear portion of the model vehicle body.

FIG. 3 shows wheel wells 100C and 100D being secured together to one another by a rear support member 16 before being attached to the rear portion of the vehicle body 200. As with the front wheel wells 100A and 100B, wheel wells 100C and 100D, may be secured to the rear support member 16 by using a number of fasteners 18A-18D (e.g., four are shown), through a number of support member bores 22A-22D, and then further into a number of support attachment bores 20A-20D in rear support member 16.

Figure 5:
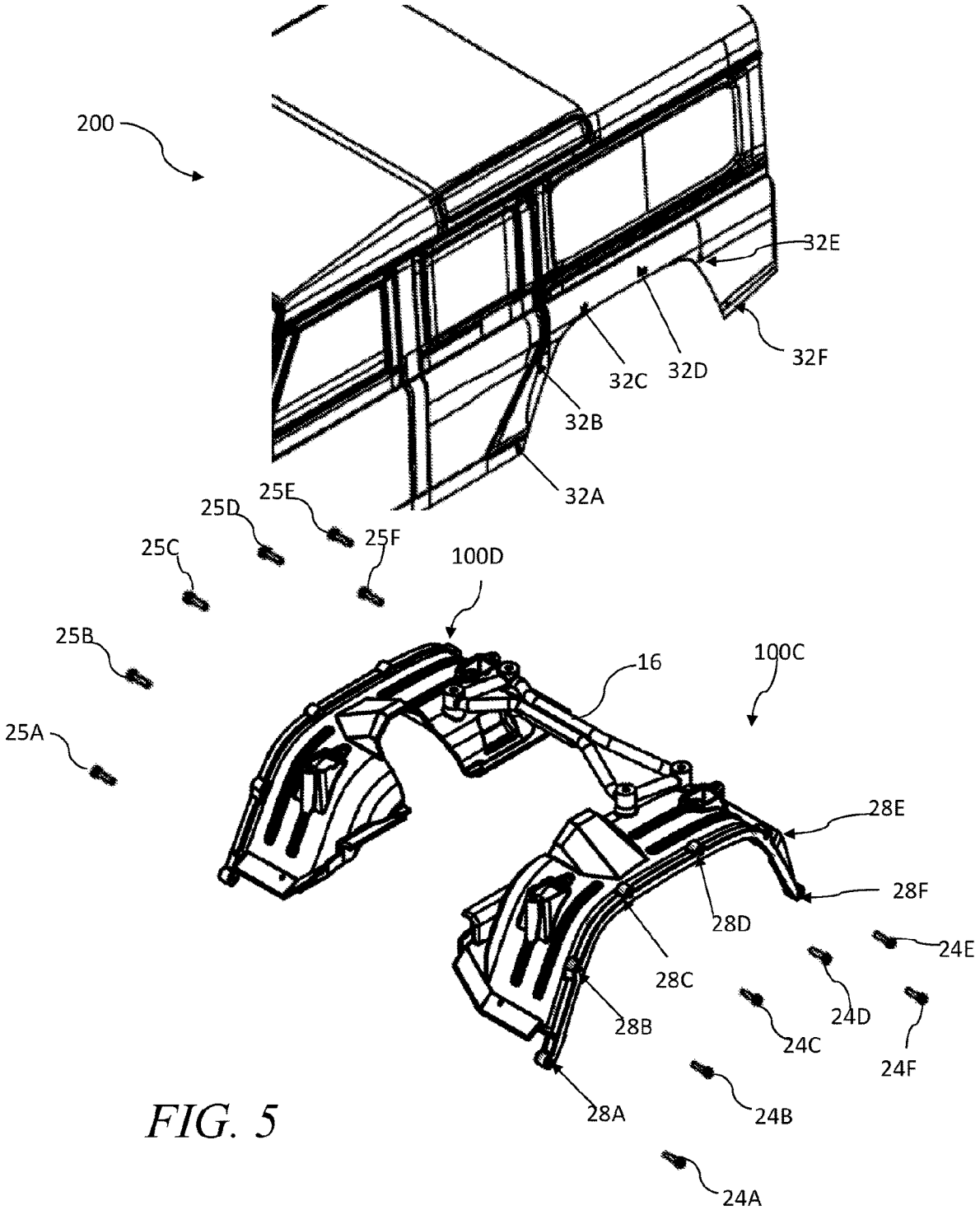
FIG. 5 illustrates the left and right rear wheel wells assembled with a rear supporting member.

As with the front, connecting the left and right wheel wells 100C, 100D creates a rigid structure as shown in FIG. 5 that may provide the rear portion of the vehicle body 200 with additional support when the wheel wells 100C, 100D are attached to the vehicle body 200. The fasteners used for connecting wheel wells 100C and 100D may include but is not limited to screws, nails, bolts, pins, clips, lugs and the like, or the components may be snapped in place, held with adhesive, or any other form of fastening known or developed.

FIGS. 4 and 5 show how the connected wheel wells 100A and 100B and wheel wells 100C and 100D may be attached to front and rear portion of the vehicle body 200, respectively. In FIG. 4, the wheel wells 100A and 100B may be secured to the front portion of vehicle body 200 by positioning the wheel wells 100A, 100B directly below and adjacent the interior surface of the vehicle body 200. A number of body attachment bores 2A-2E (e.g., five are shown) on wheel wells 100A and 100B are lined up with a corresponding number of vehicle body bores 30A-30E (e.g., five are shown on the left side of the vehicle body 200, the right side is a mirror image of the vehicle body bores on the left), around the wheel recesses on the front portion of the vehicle body 200.

In some embodiments, mechanical fasteners 24A-24E may then be used to secure wheel wells 100A and 100B to the vehicle body 200 by fasteners 24A-24E via the vehicle body bores 30A-30E in the vehicle body 200 and into body attachment bores 2A-2E. Wheel well 100A may be secured such that a portion of the vehicle body 200 is secured between the mechanical fasteners 24A-24E and the wheel well 100A itself (e.g., such as a lower portion of body around the wheel recess). The mechanical fasteners securing the wheel wells 100A-100D to vehicle body 200 may include but is not limited to screws, nails, bolts, pins, clips, lugs and the like.

FIG. 5 shows how wheel wells 100C and 100D may be to the rear portion of vehicle body 200. Similar to as in wheel wells 100A and 100B, wheel wells 100C and 100D may be secured by first being positioned directly below and adjacent the interior surface of the vehicle body 200 such that a number of body attachment bores 28A-2F (e.g., six are shown) on wheel wells 100C and 100D line up with a corresponding number of vehicle body bores 32A-32F (e.g., six are shown) around each of the left and right wheel recesses on the rear portion of the vehicle body 200.

In some embodiments, mechanical fasteners 24A-24F may then be used to secure wheel well 100C to the vehicle body 200 by fasteners 24A-24F via vehicle body bores 38A-38F in the vehicle body and into body attachment bores 28A-28F. Wheel well 100C may be secured such that a portion of the vehicle body 200 is secured between the mechanical fasteners 24A-24F and the wheel well 100C itself (e.g., such as a lower portion of the body around the wheel recess).

Figure 6:
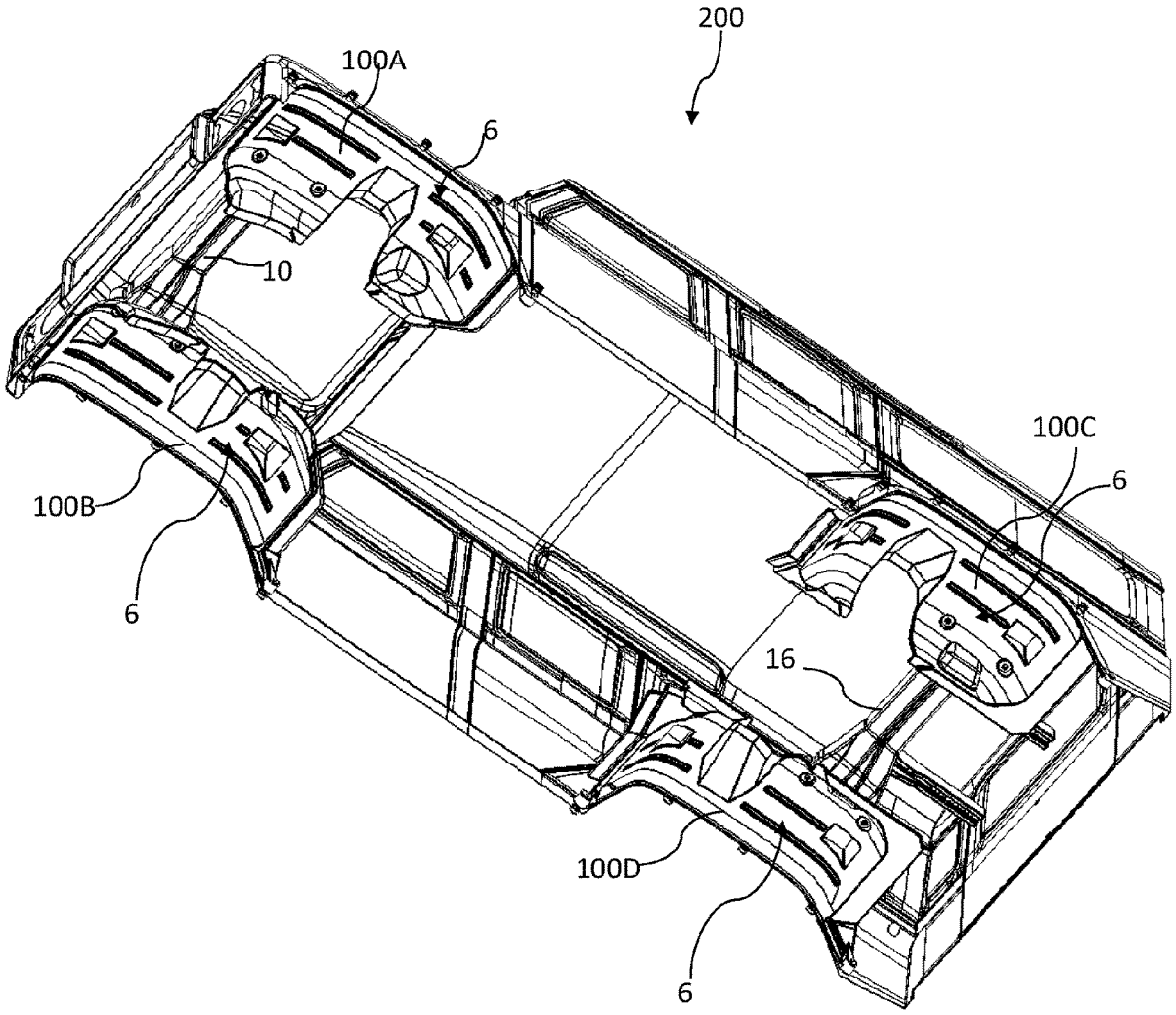
FIG. 6 illustrates a perspective of the front and rear wheel wells secured to the model vehicle body.

FIG. 6 shows wheel wells 100A-100D secured to vehicle body 200. The interior surface 6 of wheel wells 100A-100D may enclose the recess in the vehicle body 200 where each of the wheels rotate to keep dust, rocks, and debris out of the interior portion of the model vehicle, as well as block the inner surfaces of the vehicle body 200 from being viewed. Even though the wheel wells 100A-100D are shown as substantially flush to the exterior of the vehicle body, the wheel wells 100A-100D may extend beyond the surface of the body surrounding the recesses, such as fender flares or body recess molding.

Figure 7A:
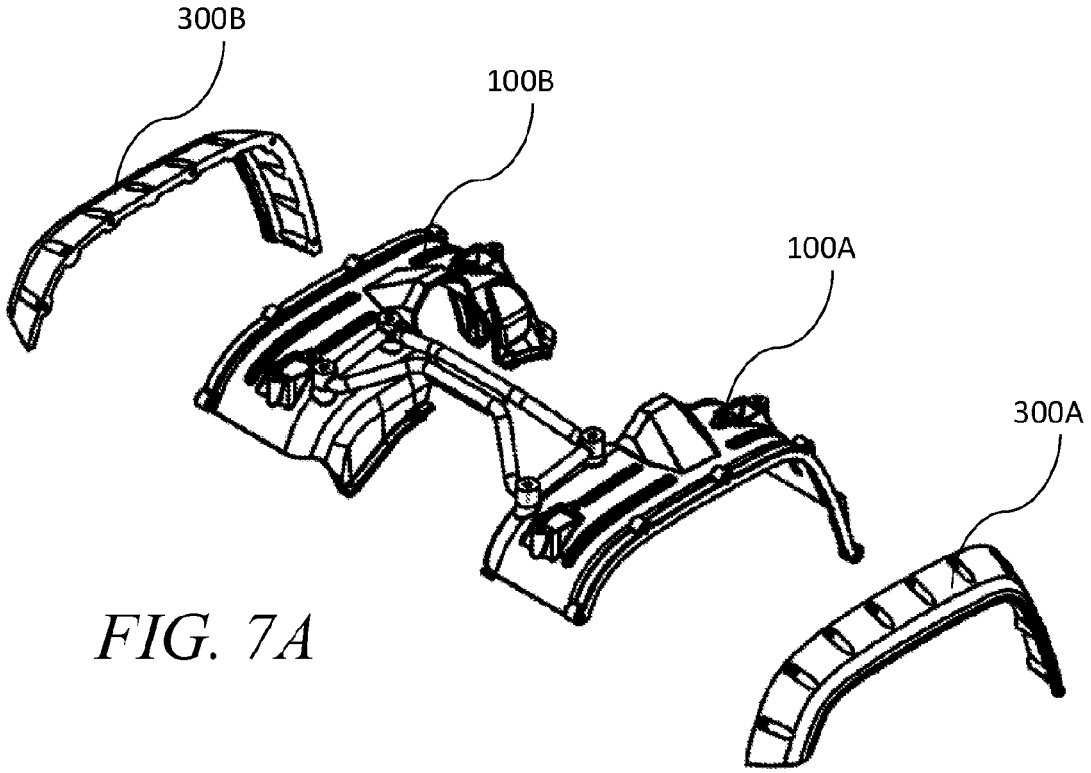
FIGS. 7A and 7B illustrate the front and rear wheel wells, respectively, with optional fender flares.
Figure 7B:
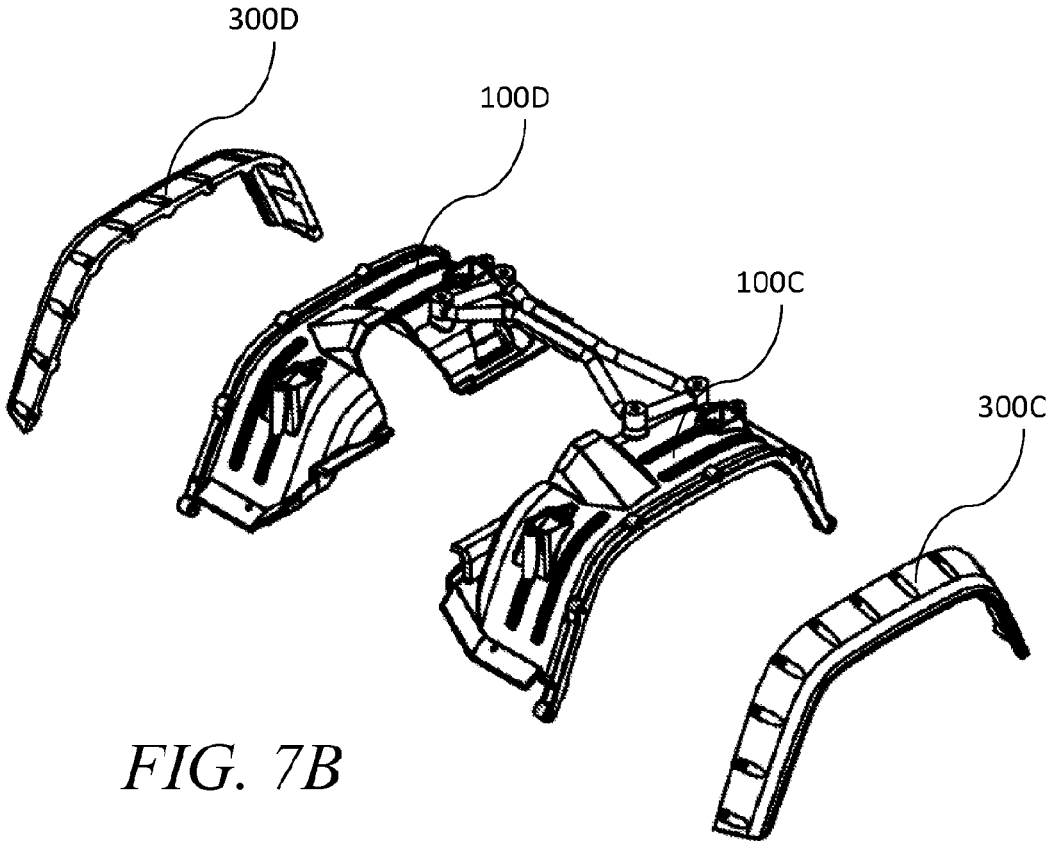

FIGS. 7A-7B and 8A-8B show an alternative embodiment of wheel wells 100A-100D further comprising fender flares 300A-300D attached to the vehicle body 200. As shown in FIGS. 7A and 7B, each of the wheel wells 100A-100D may have corresponding fender flares 300A-300D that match the overall contoured shape of each of the wheel well 100A-100D, respectively.

Figure 8A:
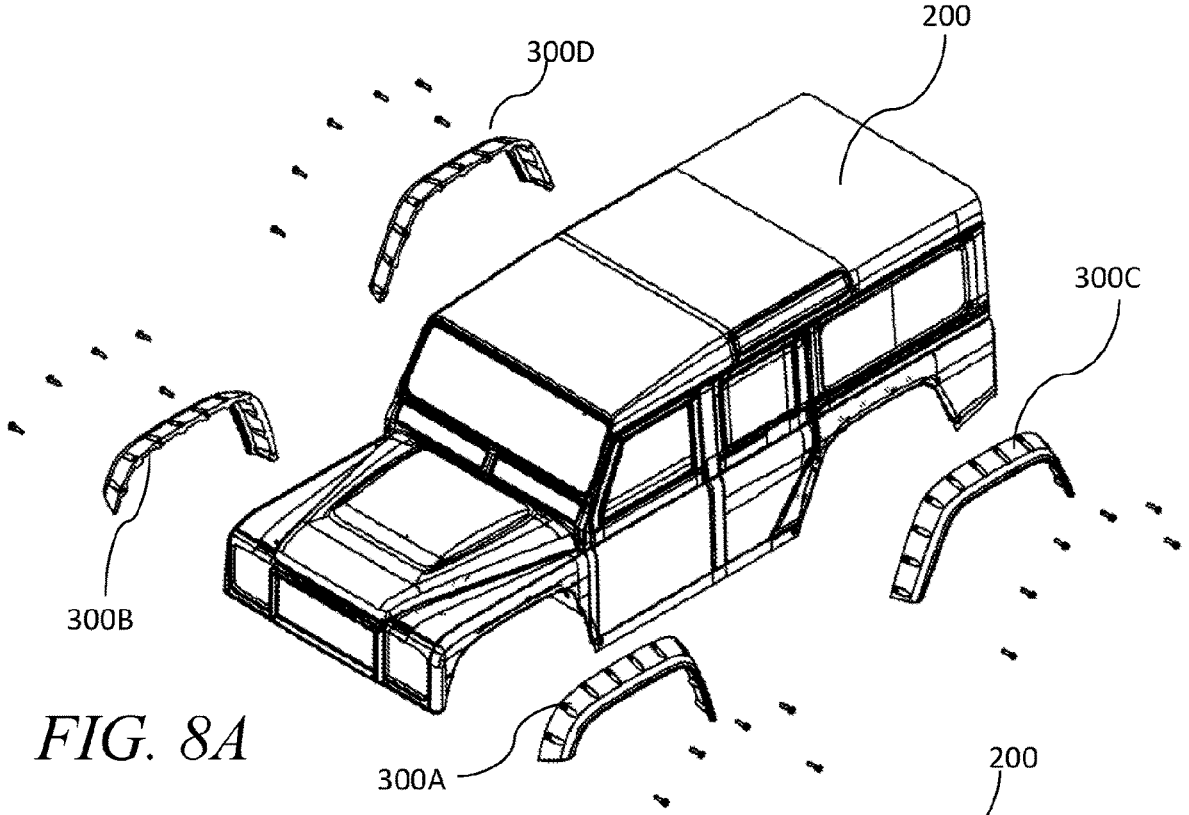
FIGS. 8A and 8B illustrate the optional fender flares secured to the model vehicle body.
Figure 8B:
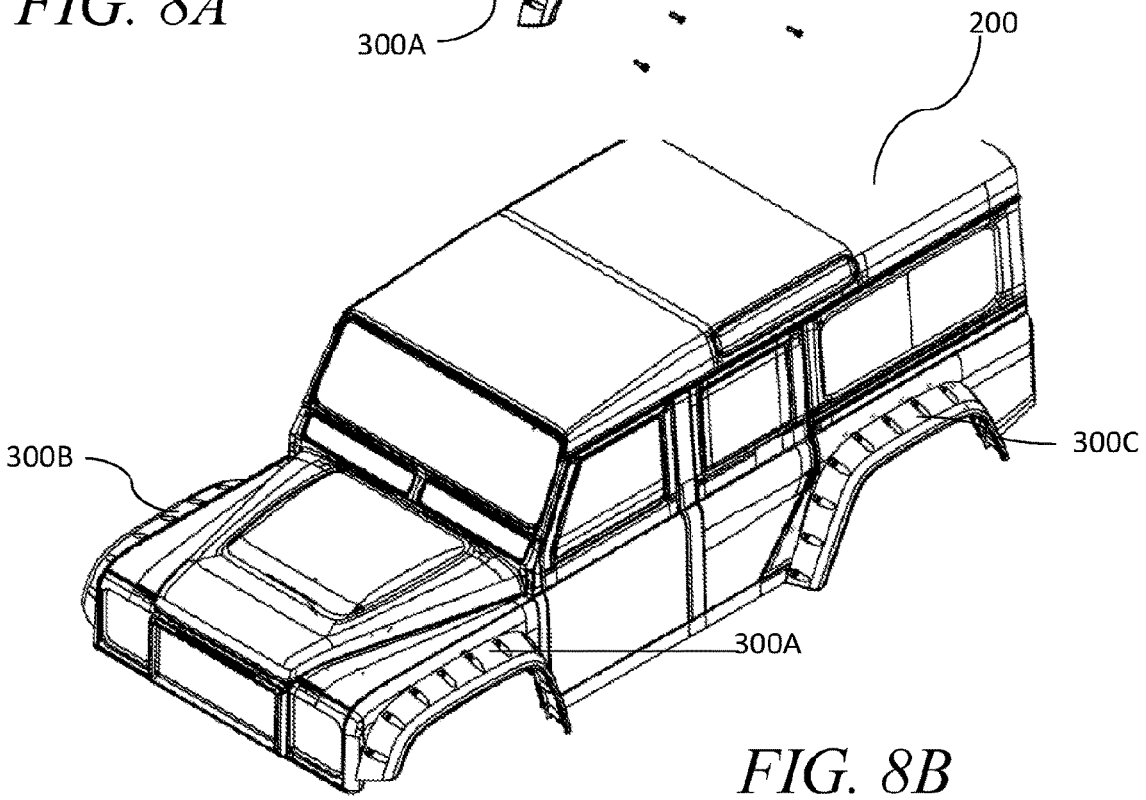

FIGS. 8A-8B show how the fender flares 300A-300D may be configured with corresponding bores such that the original fasteners used to secure wheel wells 100A-100D to vehicle body 200, may also be used to simultaneous secure the optional fender flares 300A-300D to the vehicle body 200. FIG. 8B shows the fender flares 300A-300D secured to the vehicle body 200.

In other embodiments, the fender flares 300A-300D may have a series of protrusions that snap into place via bores located in the body instead of using mechanical fasteners. In other alternatives, the fender flares 300A-300D may be integrally formed with the wheel wells 100A-100D and the lower portion of the vehicle body surrounding the recesses glued into a channel left between the wheel wells 100A-100D and the fender flares 300A-300D.

Figure 9:
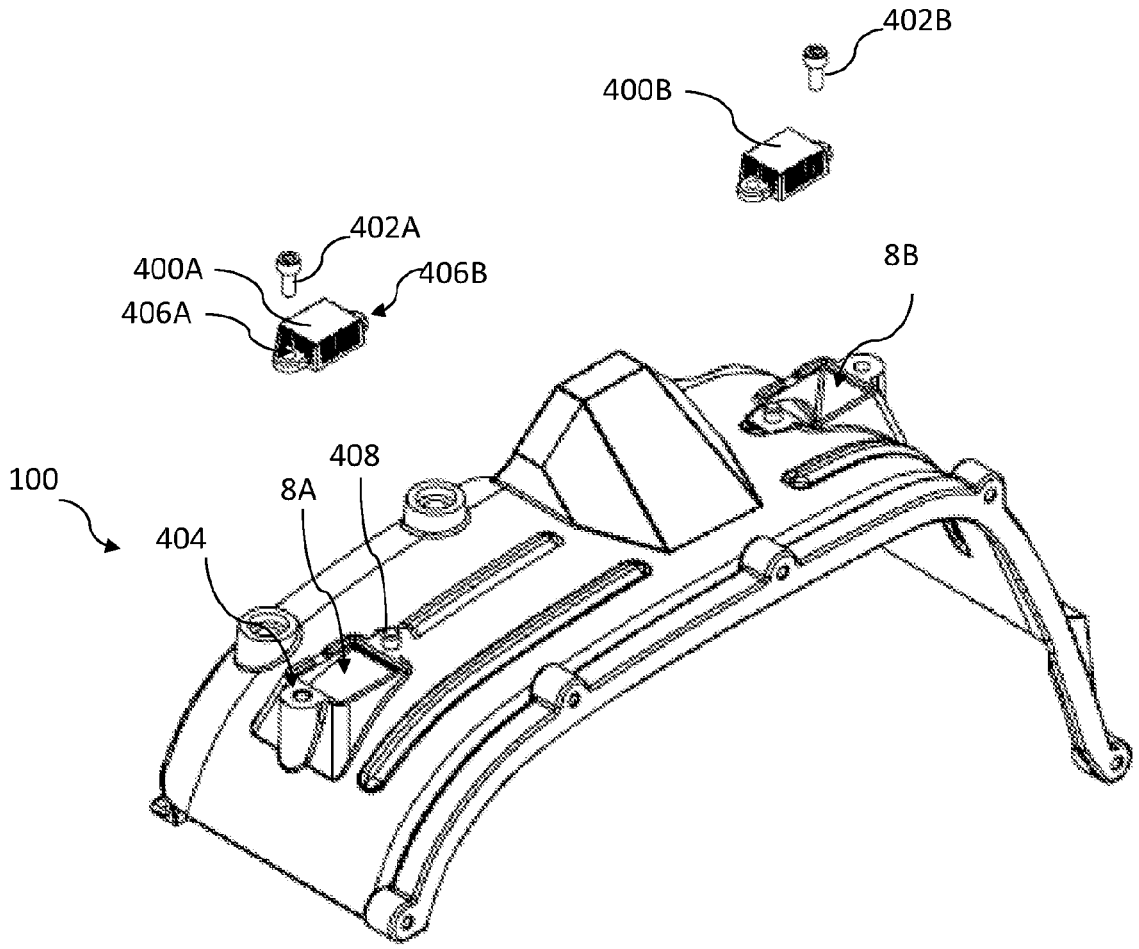
FIG. 9 illustrates the wheel well configured with optional rock lights.

Turning now to FIG. 9, in an alternative embodiment, the wheel wells 100 may further comprise a number of rock light openings 400A, 400B (e.g., two are shown) for attaching a corresponding number of rock lights 400A, 400B (e.g., two are shown) to a wheel well 100. Each of the rock light openings 8A, 8B may comprise a bore and an extrusion for mounting the rock lights 400A, 400B. In the embodiment shown, a rock light opening 8A is bordered by bore 404 and extrusion 408. Rock light 400A is bordered by mounting holes 406A and 406B. Rock light 400A may be mounted over rock light opening 8A by affixing mechanical fastener 402A through mounting hole 406A and into bore 404 in wheel well 100, and fitting extrusion 408 into mounting hole 406B in rock light 400A. Rock light 400B may similarly be mounted over rock light opening 8B using mechanical fastener 402B. The mechanical fasteners used for may include but is not limited to screws, nails, bolts, pins, clips, lugs and the like, or the components may be snapped in place, held with adhesive, or any other form of fastening known or developed.

Figure 10A:
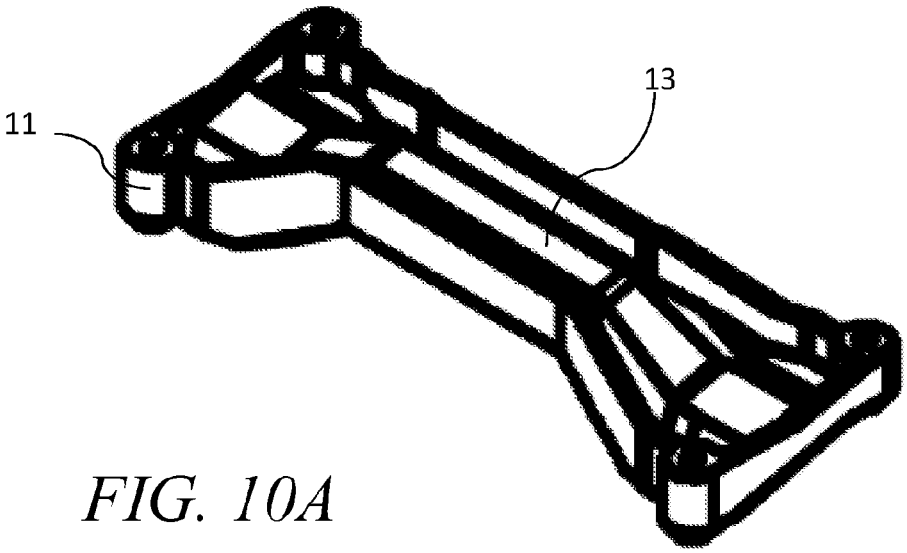
FIGS. 10A and 10B illustrate additional embodiments of the front and rear support members.
Figure 10B:
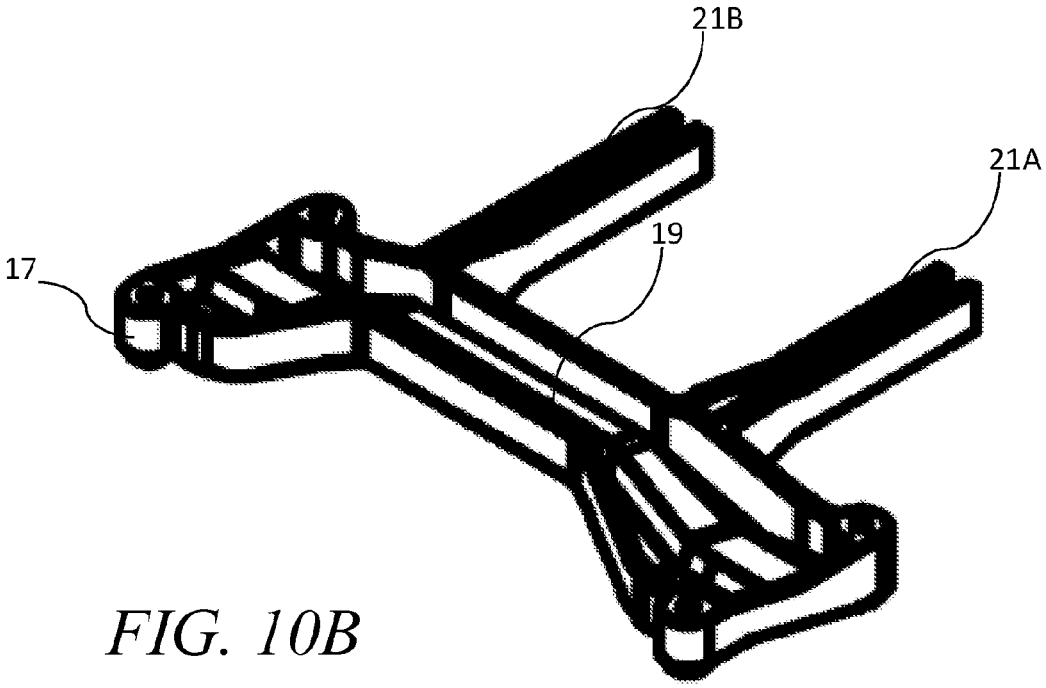

FIGS. 10A and 10B shows additional embodiments for the front support member 11 for connecting wheel wells 100A and 100B, and rear support member 17, for connection wheel wells 100C and 100D. Front support member 11 further comprises a front member surface 13 extending throughout the body of the support member 11. Rear support member 17 similarly further comprises a rear member surface 19 extending throughout the body of support member 17. Support member 17 further comprises a pair of extension members 21A and 21B to provide additional support when securing wheel wells 100C and 100D to the rear portion of vehicle body 200.

Although only a few example embodiments have been described in detail above, those skilled in the art will readily appreciate that a wide range of variations, modifications, changes, and substitutions are contemplated in the foregoing disclosure and, in some instances, some features of the present disclosure may be employed without a corresponding use of the other features In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A wheel well assembly for a model vehicle comprising:

a first wheel well configured to fit within a first wheel well recess of a model vehicle body;

a second wheel well configured to fit within a second wheel well recess of the model vehicle body provided opposite to the first wheel well recess;

a support member rigidly coupling the first wheel well to the second wheel well; and wherein the first wheel well and the second wheel well are configured to be respectively coupled to a first and second inside body surface surrounding the respective first and second wheel well recesses.

2. The wheel well assembly according to claim 1, further comprising:

a first fender flare configured to couple through the first inside body surface to first body attachment bores of the first wheel well;

a second fender flare configured to couple through the second inside body surface to second body attachment bores of the second wheel well.

3. The wheel well assembly according to claim 2, wherein the first and the second fender flares are respectively coupled to the corresponding first or the second wheel wells via mechanical fasteners.

4. The wheel well assembly according to claim 2, wherein the first and the second fender flares are respectively coupled to the corresponding first or the second wheel wells via snap fit connections.

5. The wheel well assembly according to claim 1, wherein at least one of the first or the second wheel wells further comprise:

a rock light mounting location.

6. The wheel well assembly according to claim 5, further comprising:

a rock light coupled to the rock light mounting location.

7. The wheel well assembly according to claim 1, wherein the first and the second wheel wells are coupled to the model vehicle body via mechanical fasteners.

8. The wheel well assembly according to claim 1, wherein the first and the second wheel wells are rigidly coupled to the support member via mechanical fasteners.

9. The wheel well assembly according to claim 1, wherein the first wheel well further comprises a first groove corresponding to the first wheel well recess;

wherein a first bottom portion of the first wheel well recess fits within the first groove when the first wheel well is coupled to the model vehicle body;

wherein the second wheel well further comprises a second groove corresponding to the second wheel well recess; and wherein a second bottom portion of the second wheel well recess fits within the second groove when the second wheel well is coupled to the model vehicle body.

10. A wheel well system for a model vehicle comprising:

a front wheel well assembly comprising:

two front wheel wells configured to fit within corresponding front wheel well recesses of a model vehicle body;

a front support member fixedly coupling the two front wheel wells to one another;

a rear wheel well assembly comprising:

two rear wheel wells configured to fit within corresponding rear wheel well recesses of the model vehicle body; and a rear support member fixedly coupling the two rear wheel wells to one another;

wherein the front and the rear wheel well assemblies are respectively configured to be attached to the corresponding front and the rear wheel well recesses of the model vehicle body; and wherein the front and rear wheel well assemblies are respectively configured to fixedly couple one side of each of the corresponding front and the rear wheel well recesses to an opposite side of each of the corresponding front and the rear wheel well recesses the model vehicle body.

11. The wheel well system according to claim 10, further comprising:

two front fender flares configured to mount on front external surfaces of the front wheel well recesses and further configured to fixedly couple to the front wheel well assembly; and two rear fender flares configured to mount on rear external surfaces of the rear wheel well recesses and further configured to fixedly couple to the rear wheel well assembly.

12. The wheel well system according to claim 11, wherein the two front fender flares are configured to mount to front wheel well assembly via front body attachment bores provided in each of the two front wheel wells.

13. The wheel well system according to claim 10, wherein the front wheel well assembly and the front support member are a single integrated component.

14. The wheel well system according to claim 10, wherein at least one of the front or the rear wheel well assemblies further respectively comprise front or rear rock light mounting locations in each of the corresponding front or rear wheel wells.

15. A model vehicle body comprising:

a front wheel well assembly comprising:

two front wheel wells configured to fit within corresponding front wheel well recesses of a model vehicle body;

a front support member fixedly coupling the two front wheel wells to one another;

a rear wheel well assembly comprising:

two rear wheel wells configured to fit within corresponding rear wheel well recesses of the model vehicle body; and a rear support member fixedly coupling the two rear wheel wells to one another;

wherein the front and the rear wheel well assemblies are respectively fixedly coupled to interior surfaces of the corresponding front and the rear wheel well recesses, fixedly coupling one side of the model vehicle body to an opposite side of the model vehicle body.

16. The model vehicle body according to claim 15, wherein the front and the rear wheel well assemblies further comprise:

a plurality of body bores; and wherein the model vehicle body is fixedly coupled to the front and the rear wheel well assemblies via the plurality of body bores.

17. The model vehicle body according to claim 15, wherein the front and the rear wheel well assemblies further comprise a rock light mounting location.

18. The model vehicle body according to claim 17, further comprising:

a rock light;

wherein the rock light is mounted in the rock light mounting location.

19. The model vehicle body according to claim 15, further comprising:

front fender flares;

rear fender flares;

wherein the front fender flares are mounted to outside surfaces of the front wheel well recesses and attached to the front wheel wells; and wherein the rear fender flares are mounted to outside surfaces of the rear wheel well recesses and attached to the rear wheel wells.

20. The model vehicle body according to claim 19, wherein the front fender flares are attached to the front wheel wells via mechanical fasteners; and wherein the rear fender flares are attached to the rear wheel wells via mechanical fasteners.

* * * * *